United States Patent [19]

Ganter

[11] 4,161,864

[45] Jul. 24, 1979

[54] ELECTRONIC WATCH, PARTICULARLY A QUARTZ-CONTROLLED WRISTWATCH

[75] Inventor: Wolfgang Ganter, Schramberg, Fed. Rep. of Germany

[73] Assignee: Gebrüder Junghans GmbH, Schramberg, Fed. Rep. of Germany

[21] Appl. No.: 846,120

[22] Filed: Oct. 27, 1977

[30] Foreign Application Priority Data

Nov. 23, 1976 [DE] Fed. Rep. of Germany ..... 2653081

[51] Int. Cl.[2] ..... G04C 3/00

[52] U.S. Cl. ..... 58/23 R; 58/85.5

[58] Field of Search ..... 58/23 R, 23 D, 85.5

[56] References Cited

U.S. PATENT DOCUMENTS

| | | | |
|---|---|---|---|
| 4,007,347 | 2/1977 | Haber | 58/85.5 X |
| 4,023,002 | 5/1977 | Wuthrich et al. | 58/23 R X |
| 4,092,821 | 6/1978 | Wirz | 58/23 R X |

*Primary Examiner*—Stanley J. Witkowski

*Attorney, Agent, or Firm*—Scully, Scott, Murphy & Presser

[57] ABSTRACT

An electronic watch, particularly a quartz-controlled wristwatch including an electronic circuit for the control of an indicator device. The watch includes an indicator setting arrangement having a setting shaft arrestable in different positions, and a support plate therefor. A stop or arresting spring for the setting shaft concurrently constitutes a switch element for controlling a conductor path in the electronic circuit.

9 Claims, 4 Drawing Figures

ELECTRONIC WATCH, PARTICULARLY A QUARTZ-CONTROLLED WRISTWATCH

BACKGROUND OF THE INVENTION

1. Field of the Invention

The present invention relates to an electronic clock or watch, in particular, a quartz-controlled wristwatch which includes an electronic circuit for the control of an indicator device, an indicator regulating arrangement with a setting shaft which is arrestable or capable of being stopped in different positions, as well as a carrier plate.

2. Discussion of the Prior Art

The locking of a setting or regulating shaft in a wristwatch is effected, in a known manner, through the intermediary of a stop spring which cooperatively engages in locking grooves. These types of stop springs are mostly constituted of single-piece leaf springs, produced through the utilization of a stamping process, and are fastened on a carrier plate, base plate, or the like, through the interposition of at least one fastening element. Independently of the manufacturing requirements, mounting and alignment required for this arrangement is being relatively extensive, and the stop spring only possesses the function of an arresting or locking element.

SUMMARY OF THE INVENTION

Accordingly, it is an object of the present invention to construct a stop spring for a watch of the above-mentioned type, which is capable of concurrently assuming a plurality of functions which are necessary for the operation of the watch and, notwithstanding the foregoing, having a manufacturing cost which is appreciably lower in comparison with known devices.

The foregoing object is inventively achieved through the provision of a stop spring which operates in conjunction with arresting elements for the setting shaft, and which is concurrently constructed as a switch element, through the intermediary of which, upon actuation of the setting shaft, there may be closed or interrupted at least one current path within the electronic circuitry.

In a preferred embodiment of the invention, the stop or arresting spring is formed on the clockwork or watch movement platform and integrally constructed therewith as a stamped component. Through this measure alone, there is achieved an appreciable reduction in the manufacturing costs of the watch. The auxiliary function of a switch element by means of which, upon actuation of the setting shaft, at least one current path was interruptable within the electronic circuitry, heretofore, was either not required, or was assumed by further switch elements independently of the setting shaft. The stop spring itself is hereby constructed as a contact element which, on the one hand, is grounded across the watch movement bridge and, on the other hand, upon actuation of the setting shaft in dependence upon the position thereof and the depth of the arresting groove. This is accomplished through the intermediary of an angular contact arm adapted to be brought into pressure contact with a conductor path which is arranged on a printed circuit board mounting the electronic circuitry. Moreover, in accordance with a modified embodiment of the invention, in lieu of a contact arm, the stop spring may also comprises a switch finger by means of which, upon actuation of the setting shaft for interrupting the current circuit, a resilient contact element engaged by the switch finger may be pressed against a conductor path on the printed circuit board.

BRIEF DESCRIPTION OF THE DRAWINGS

Further advantageous embodiments may now be ascertained from examples of the invention given in the following detailed description, taken in conjunction with the accompanying drawings; in which.

DETAILED DESCRIPTION

Figure 1:
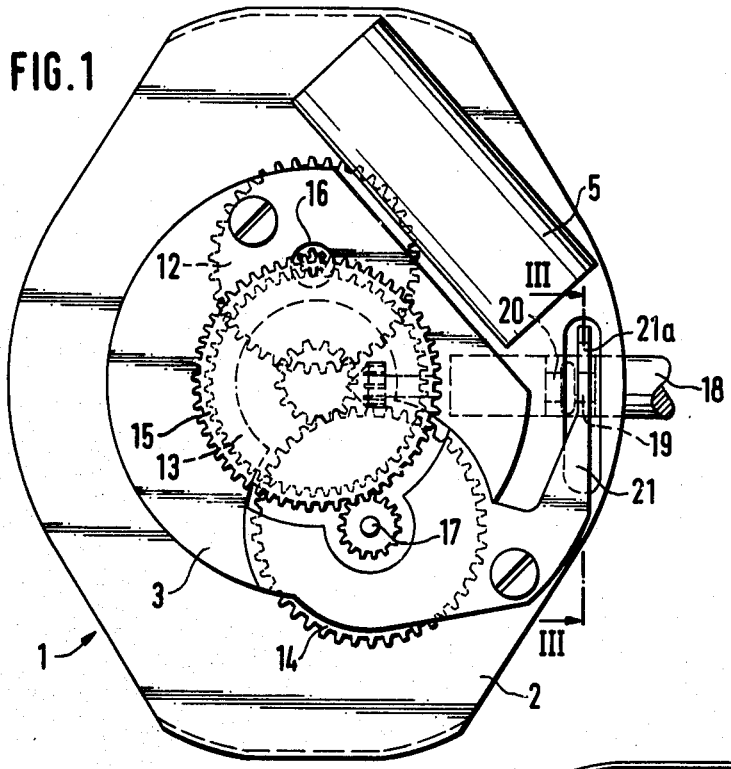
FIG. 1 is a plan view of the front of a clockwork or watch movement incorporating the inventive arrangement.
Figure 2:
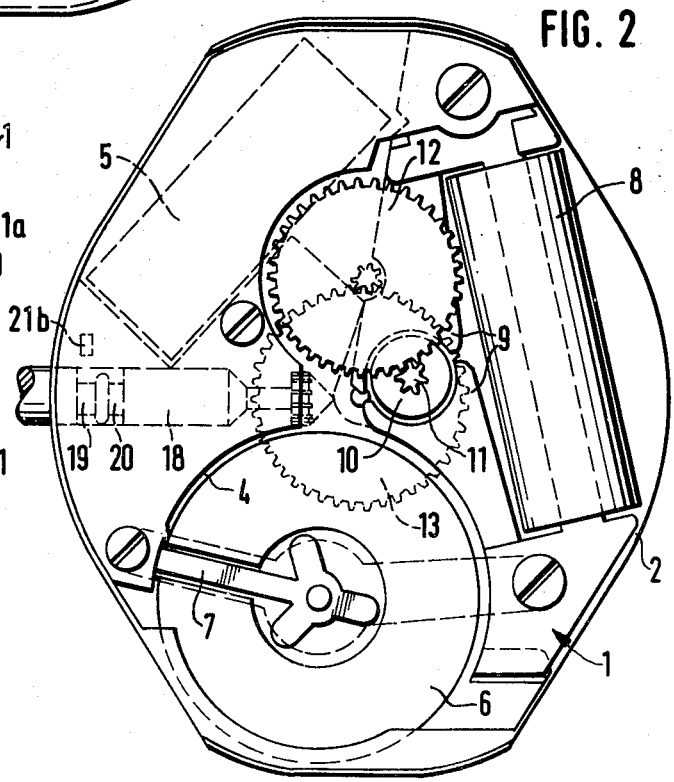
FIG. 2 is a plan view of the rear of the watch movement illustrated in FIG. 1.

Referring to FIGS. 1 and 2 of the drawings, there is illustrated a clockwork or movement 1 for a wristwatch, which includes a support plate 2 on which there is arranged a movement plate 3 on the side towards the dial plate (FIG. 1), as well as a printed circuit board 4 towards the bottom side (FIG. 2), and a gear plate (not shown). The printed circuit board 4 is mounted on the support plate 2 and serves as a carrier for the electronic components of the watch; these consisting of a quartz crystal oscillator 5, as well as (not shown) an encased integrated switching network and frequency adjusting elements. The current for these electronic components is supplied by a suitable button battery (not shown) which is adapted to be seated in a receiving recess 6, and the connection of which to the printed circuit board 4 is effected through the intermediary of a contact lug 7 which, on the one hand, contacts the negative pole of the battery and, on the other hand, has an input terminal to the electronic circuitry. An output terminal of the electronic circuit is connected to the drive or power coil 8 of a stepping motor, the latter of which further comprises a two-part stator 9 and a rotor 10 with a power-takeoff pinion 11. Associated with this stepping motor is a gear drive train for the motivation of the indicator hands (not shown), a second-hand gear 12 which interconnects with the output pinion 11 of the rotor, a minute-hand gear 13, a change gear 14, and an hour-hand gear 15. The second-hand gear 12, on the one side, is hereby supported within the gear plate and, on the other side, in a bearing location 16 in the movement plate 3. In addition to the foregoing, the last-mentioned serves for the covering and the axial securing of the change gear 14 which is freely rotatably mounted on a rigid bearing pin 17. There is additionally provided an indicator hand setting arrangement which consists of a setting gear operating in cooperation with the minute-hand gear and a manually actuatable setting shaft 18, the latter of which is manually displaceable into two arrested or stopped positions which are marked through the distance between two arresting grooves 19 and 20. For the mechanical positioning of the setting shaft 18 in one of the respective locking grooves 19 or 20 there is provided a stop or arresting spring 21, which is constituted of a leaf spring and, inventively, is integrally formed with the movement plate 3 as a stamped component. Hereby the stop spring 21 extends over the setting shaft 18 and with a portion thereof forming an arresting arm 21*a* extends sideways into the locking groove 19 or 20 which is presently associated with an arresting position.

Figure 3:
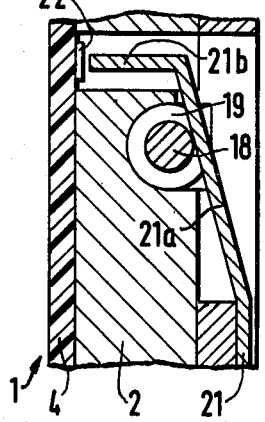
FIG. 3 is an enlarged scale fragmentary section of the invention taken along line 3—3 in FIG. 1.

Moreover, in an inventive manner, the locking spring is also formed so as to constitute a switch element. Hereby, as illustrated in detail in FIG. 3 of the drawings, the outer end of the locking arm 21*a* is angled and forms a contact arm 21*b* extending in perpendicular relative to the printed circuit board 4, and which is adapted to be brought into pressure-contact with a conductor path 22 located in the circuit board. In order to facilitate this switching sequence, the two arresting grooves 19, respectively 20 in the setting shaft are formed with different depths, in such a manner, that the contacting connection between the contact arm 21*b* and conductor path 22 is closed upon the setting shaft being displaced into a corrective position, and opened when the setting shaft is not in a corrective position.

Figure 4:
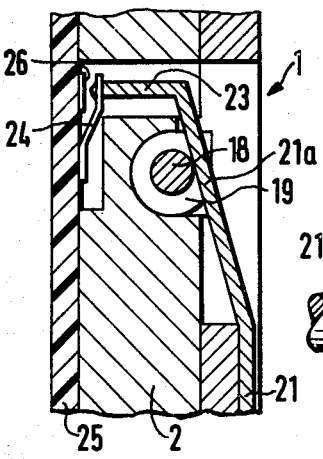
FIG. 4 is a sectional view similar to that of FIG. 3 illustrating a modification of the invention.

In the embodiment pursuant to FIG. 4, the outer bent or angled end of the locking arm 21*a* is not constructed as a contact arm but is in the shape of a switch finger 23 in engagement with a resilient contact element 24 which is mounted on a printed circuit board 25. This contact element 24 is adapted to be brought into or out of contact with a conductor path 26, which is also arranged on the printed circuit board 25, through the intermediary of the switch finger 23, dependent upon the position of the setting shaft and the depth of the respective arresting groove 19 or 20. At closed contact connection, similar to the embodiment pursuant to FIG. 3, a current path is interrupted within the electronic circuit. In the illustrated exemplary embodiments, this contact connection is predicated on the function of a reset-contact in which the current circuit from the integrated switch circuit to the stepping motor is actively interrupted during an indicator hand setting sequence and at closed contact connection, so that during an indicator hand setting sequence no drive impulses can be transmitted to the stepping motor, and overlapping of manually introduced adjusting movements of the gear drive train with motor-generated drive movements are effectively prevented.

It is readily apparent that the invention is not limited to the embodiments illustrated in the drawings, but other solutions may be ascertained which fall within the scope and purview of the present invention. The foregoing is particularly applicable to the arrangement and construction of the arresting spring, as well as its actuation by means of the setting shaft, which need not be identical with a winding shaft, and finally, the location, type and function of the contact connection within the electronic circuitry.

What is claimed is:

1. In an electronic watch, particularly a quartz-controlled wristwatch; an indicator-hand arrangement; an electronic circuit for controlling said indicator-hand arrangement; hand setting means including a setting shaft adapted to be arrested in different positions thereof; and a support plate, the improvement comprising: arresting means on said setting shaft; and an arresting spring operatively associated with said arresting means, said spring concurrently comprising a switch element through which at least one current path within said electronic circuit is selectively closed and interrupted.

2. An electronic watch as claimed in claim 1, said arresting spring being a leaf spring and being formed with said support plate.

3. An electronic watch as claimed in claim 1, said support plate comprising a movement plate, said arresting spring being a leaf spring and being formed with said support plate.

4. An electronic watch as claimed in claim 3, said arresting spring being integrally formed with said movement plate and being constituted of a stamped component.

5. An electronic watch as claimed in claim 1, said arresting means comprising spaced grooves of different depths formed in said setting shaft, said arresting spring including an arresting arm engageable in said grooves, an extreme end of said arresting arm being angled to form a contact arm adapted to be placed in pressure-contact with a conductor path in dependence upon the position of said setting shaft and the depth of the arresting groove in which it is engaged; and printed circuit board means supporting said electronic circuit, said conductor path being arranged on said circuit board means.

6. An electronic watch as claimed in claim 1, said arresting means comprising spaced grooves of different depths formed in said setting shaft, said arresting spring including an arresting arm engageable in said grooves, an extreme end of said arresting arm forming a switch finger in contact with a resilient contact element, said contact element adapted to be placed in pressure-contact with a conductor path in dependence upon the position of said setting shaft and the depth of the arresting groove in which it is engaged; and printed circuit board means supporting said electronic circuit, said conductor path being arranged on said circuit board means.

7. An electronic watch as claimed in claim 3, said arresting spring being electrically grounded at one side thereof through said watch movement-supporting platform.

8. An electronic watch as claimed in claim 5, the contact connection between said contact arm and said conductor path being closed upon said setting shaft being displaced into a corrective position.

9. An electronic watch as claimed in claim 6, the contact connection between said contact element and said conductor path being closed upon said setting shaft being displaced into a corrective position.

* * * * *